US007825573B2

(12) United States Patent
Callahan et al.

(10) Patent No.: US 7,825,573 B2
(45) Date of Patent: Nov. 2, 2010

(54) 14 MM EXTENSION SPARK PLUG

(75) Inventors: Richard E. Callahan, Maumee, OH (US); Robert D. Freeman, Monclova, OH (US)

(73) Assignee: Federal-Mogul Ignition Company, Southfield, MI (US)

( * ) Notice: Subject to any disclaimer, the term of this patent is extended or adjusted under 35 U.S.C. 154(b) by 413 days.

(21) Appl. No.: 12/044,155

(22) Filed: Mar. 7, 2008

(65) Prior Publication Data

US 2008/0218053 A1 Sep. 11, 2008

Related U.S. Application Data

(60) Provisional application No. 60/893,392, filed on Mar. 7, 2007.

(51) Int. Cl.
*H01T 13/00* (2006.01)

(52) U.S. Cl. ..... 313/143; 313/135; 313/145

(58) Field of Classification Search ..... None
See application file for complete search history.

(56) References Cited

U.S. PATENT DOCUMENTS

| | | | | |
|---|---|---|---|---|
| 2,129,961 | A | 9/1938 | Rabezzana | |
| 2,186,039 | A | 1/1940 | Peters et al. | |
| 2,258,810 | A | 10/1941 | Rabezzana et al. | |
| 2,262,769 | A | 11/1941 | King | |
| 2,303,389 | A | 12/1942 | Rabezzana | |
| 2,632,132 | A | 3/1953 | Delano | |
| 3,050,658 | A | 8/1962 | Lay et al. | |
| 3,330,985 | A | 7/1967 | Johnston | |
| 3,334,326 | A | 8/1967 | Besore et al. | |
| 4,145,106 | A | 3/1979 | Livingston | |
| 4,163,597 | A | 8/1979 | Brenholts | |
| 4,497,532 | A | 2/1985 | Bezusko et al. | |
| 4,671,586 | A | 6/1987 | DeBolt | |
| 4,987,868 | A * | 1/1991 | Richardson | 123/260 |
| 5,095,242 | A | 3/1992 | Richeson | |

(Continued)

FOREIGN PATENT DOCUMENTS

DE 196 11 283 10/1997

*Primary Examiner*—Ashok Patel
(74) *Attorney, Agent, or Firm*—Roberts L. Stearns; Dickinson Wright, PLLC

(57) ABSTRACT

A spark plug assembly (10) for engine applications where the combustion chamber is difficult to access when servicing or replacing a spark plug. The spark plug assembly (10) includes a fairly traditional spark plug component (28) to which an elongated tubular conduit (12) is attached, such as by welding, to a portion of the metallic shell (32). The conduit (12) contains an upper ceramic insulator (52) adjacent its top end (14) disposed in end-to-end abutting contact with an outer elastomeric insulator (58). The ceramic insulator of the spark plug component (28), herein referred to as a lower ceramic insulator (30), is surrounded by the outer elastomeric insulator (58) and held securely within the conduit (12) thereby. An inner elastomeric insulator (62) is disposed in a continuous passageway formed between aligned central bores formed in the respective upper ceramic (52) and outer elastomeric (58) insulators. The inner elastomeric insulator (62) supports and further electrically isolates an elongated electrically conductive center electrode extension (48) that is in direct electrical conductivity with the center electrode (44) of the spark plug component (28). An ignition lead wire makes electrical contact with the center electrode extension (48) and thereby delivers electrical energy at timed intervals to the spark gap.

20 Claims, 4 Drawing Sheets

U.S. PATENT DOCUMENTS

| | | | | |
|---|---|---|---|---|
| 5,163,838 | A | 11/1992 | Tura, Jr. et al. | |
| 6,068,495 | A | 5/2000 | Virchow | |
| 6,373,173 | B1 | 4/2002 | Suzuki | |
| 6,694,958 | B2 | 2/2004 | Hiramatsu | |
| 6,771,009 | B2 | 8/2004 | Nishikawa et al. | |
| 6,953,017 | B2 | 10/2005 | Matsuda | |
| 7,150,274 | B2 | 12/2006 | Iwami et al. | |
| 7,594,489 | B1 * | 9/2009 | Marrs | 123/169 PA |
| 2005/0056087 | A1 * | 3/2005 | Kiess et al. | 73/116 |
| 2005/0179183 | A1 * | 8/2005 | Paul et al. | 267/166 |
| 2005/0263145 | A1 | 12/2005 | Iwami et al. | |
| 2005/0284454 | A1 | 12/2005 | Iwami et al. | |
| 2006/0066194 | A1 | 3/2006 | Morin | |
| 2006/0158081 | A1 | 7/2006 | Shibata et al. | |
| 2006/0186780 | A1 | 8/2006 | Ogata et al. | |
| 2006/0267469 | A1 | 11/2006 | Alger, II et al. | |
| 2008/0054777 | A1 * | 3/2008 | Callahan et al. | 313/143 |

* cited by examiner

14 MM EXTENSION SPARK PLUG

CROSS REFERENCE TO RELATED APPLICATIONS

This patent application claims priority to U.S. Provisional Patent Application Ser. No. 60/893,392, filed Mar. 7, 2007, which is incorporated herein by reference in its entirety.

BACKGROUND OF THE INVENTION

1. Field of the Invention

The subject invention relates to spark plugs for igniting combustion gases in a combustion chamber of an internal combustion engine, and more particularly toward an extension type spark plug as used chiefly in stationary engine applications such as generators, pumps and the like.

2. Related Art

Extension type spark plugs are used in applications where the depth of the spark plug bore in the cylinder head requires the use of an unusually long spark plug. While specialty spark plugs can be designed for these applications, it is sometimes preferred to adapt extensions for conventional, long-life spark plugs for these purposes.

One approach to providing the necessary extensions has been to provide a kit for adapting conventional long-life spark plugs in the field by the addition of various combinations of shell extensions, upper terminal extensions and various combinations of elastomeric insulators to isolate the shell extension from the upper terminal extension. Skilled laborers must be employed to perform the required assembly due to the complexity of the operation. For example, attachment of the shell extension to the shell may use press-fit connections which are prone to coming apart in the field. Field assembly necessitates that any metallurgical bond used to attach the shell extension to the shell utilize relatively low temperature processes, such as soldering or low-temperature brazing which produce relatively weak mechanical joints which can later result in failure while installing or uninstalling the spark plug. So further, extension kits frequently utilize combinations of elastomeric and plastic insulating materials, as they are more durable with respect to field assembly and installation; however such materials do not necessarily provide desirable electrical isolation characteristics. Because field installed extensions are typically non-hermetic, moisture and other contaminants are accessible to the insulating materials, thereby diminishing their electrical isolation capabilities. Such materials also limit the maximum operating temperature of the extension spark plug based on inherent characteristics of materials such as a softening point or a glass transition point of the plastic materials used.

Very few factory-assembled extension spark plugs are known. Those that are known typically employ many of the same components and manufacturing methods described above, and thus are generally subject to the same limitations.

Therefore, it is desirable to manufacture extension spark plugs with improved reliability and an increased operating temperature range, as well as having enhanced thermal and electrical properties and resistance to environmental degradation.

SUMMARY OF THE INVENTION

A spark plug having a tubular/barrel extension of the type shown in the accompanying drawings comprises an upper ceramic insulator, a lower ceramic insulator (associated with a spark plug of conventional construction), an outer elastomeric insulator member disposed between the upper and lower ceramic insulators and within the tubular/barrel extension, and further having an inner elastomeric insulator disposed around a center electrode extension located within a central bore of both the upper ceramic insulator and the outer spring insulator.

Further and perfecting features of the invention include the outer and inner elastomeric insulators being fabricated from a silicon base or silicon containing elastomer. Still further, the invention includes locating the lower portion of the extension over a hot locked shell, and welding the extension to the shell.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
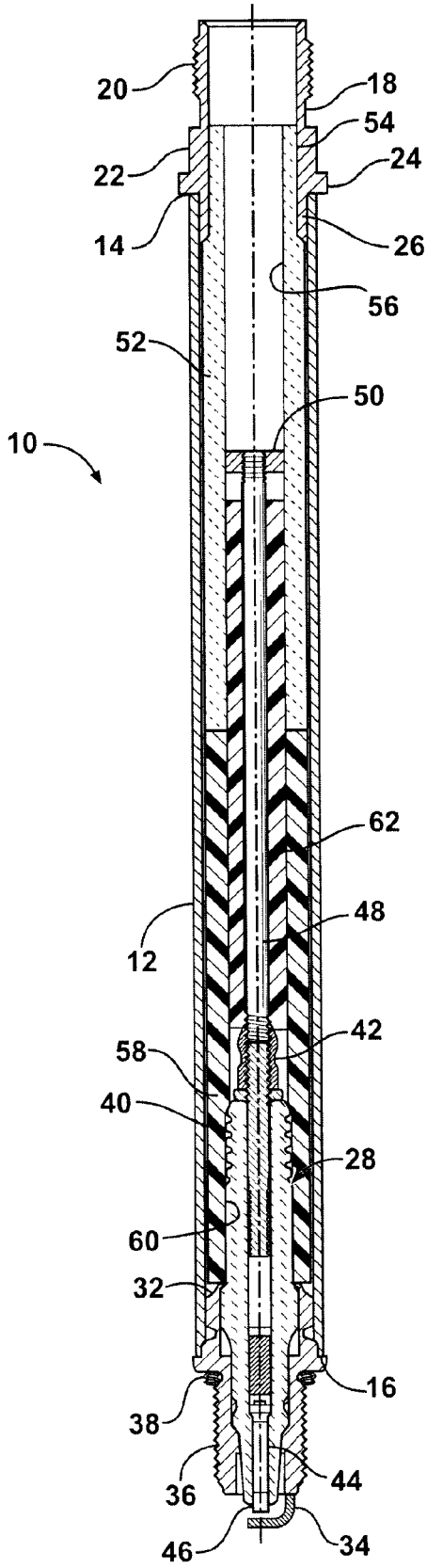
FIG. 1 is a full-length cross-sectional view through an extension spark plug according to the subject invention.
Figure 2:
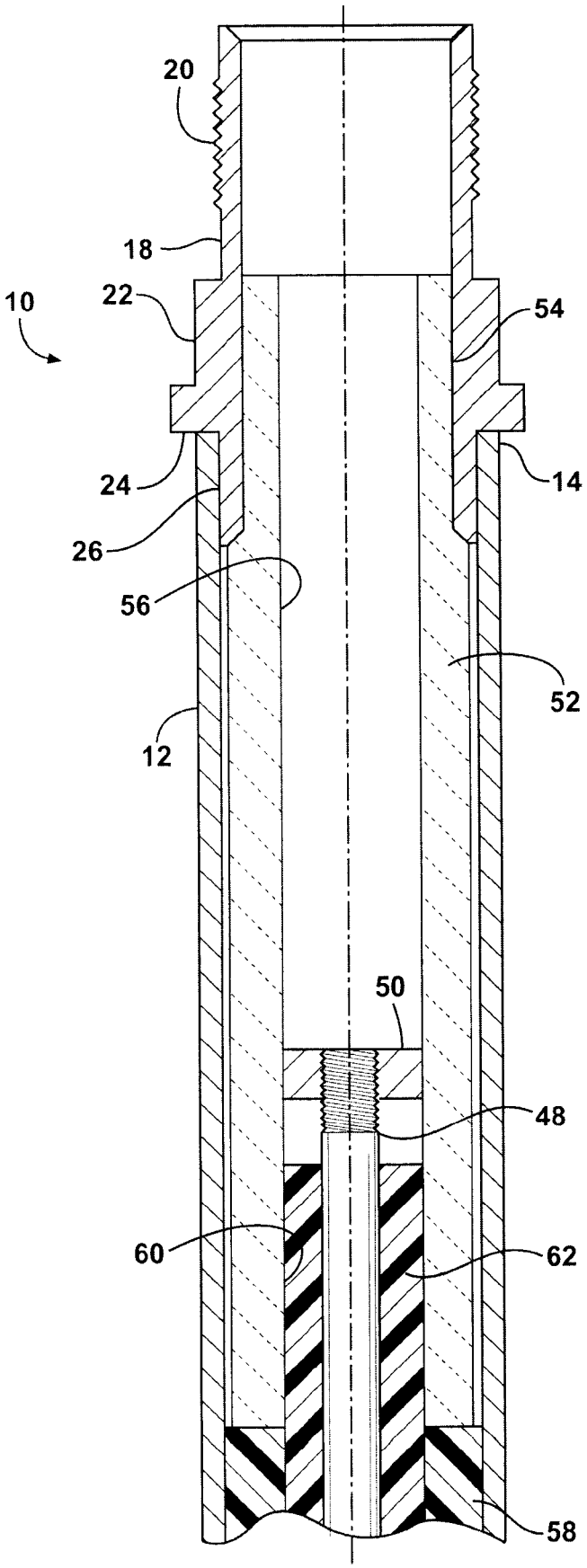
FIG. 2 is an enlarged, fragmentary cross-sectional view of the top portion of the extension spark plug assembly as shown in FIG. 1.
Figure 3:
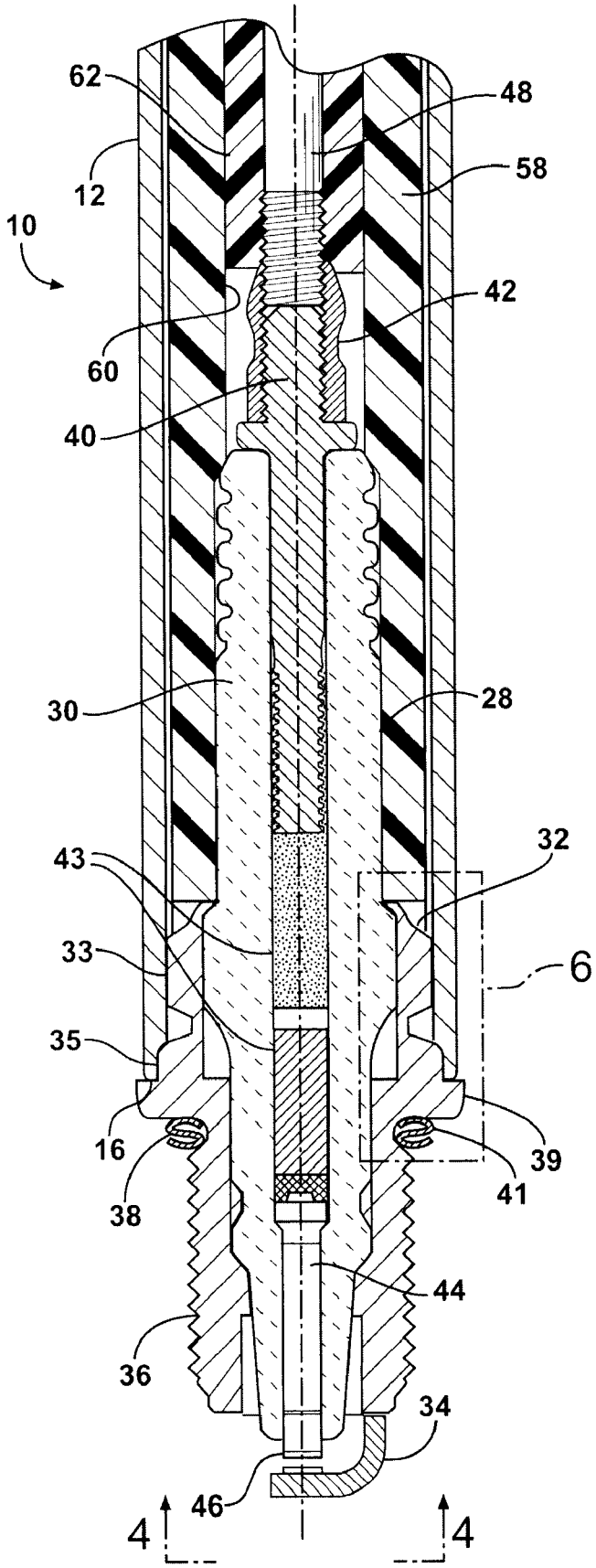
FIG. 3 is an enlarged, fragmentary cross-sectional view of the lower portion of the spark plug assembly shown in FIG. 1.
Figure 4:
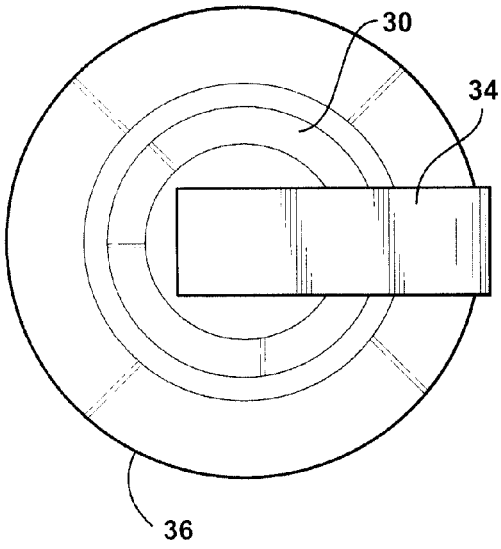
FIG. 4 is a bottom view of the extension spark plug assembly as taken generally along lines 4-4 in FIG. 3.
Figure 5:
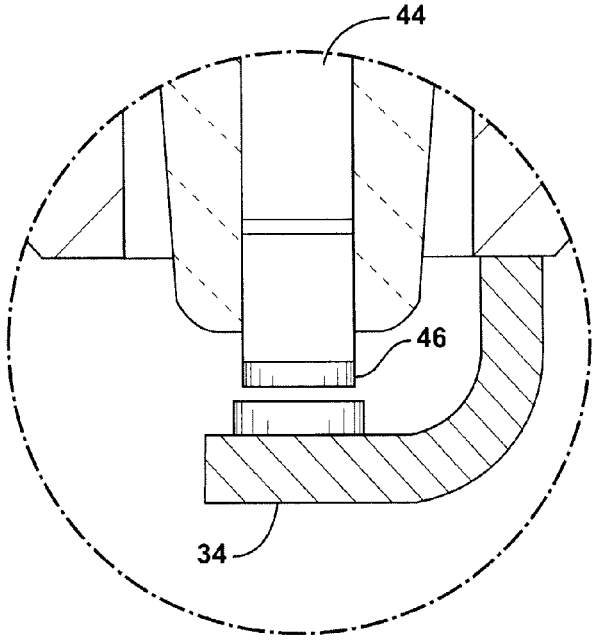
FIG. 5 is an enlarged view of the spark gap region referenced by the circumscribed area 5 in FIG. 3.
Figure 6:
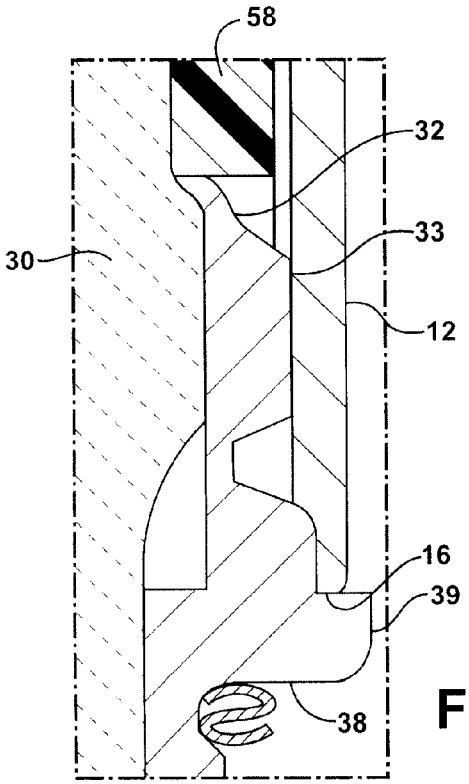
FIG. 6 is an enlarged view of the rectangular area identified by 6 in FIG. 3.

Referring to FIGS. 1-6, wherein like numerals indicate like or corresponding parts throughout the several views, an extension-type spark plug in accordance with an embodiment of the present invention is generally shown at 10. The extension spark plug 10 is of the type and size, such as M14 as but one example, used in industrial engines and other specialized applications where access to the spark plug 10 for maintenance and replacement purposes is severely limited. The spark plug assembly 10 includes a conduit sheath extension tube 12 preferably made from a corrosion and oxidation resistant metal material, such as stainless steel or an alloy thereof. The conduit 12 is substantially cylindrical along its length and has a generally thin wall section extending between top end 14 and bottom end 16. In an exemplary embodiment, conduit 12 has a length of 8-12 inches, an outside diameter of 0.8-1.0 inches and a wall thickness of about 0.06 inches.

A bushing 18 is fitted into the top end 14 of the conduit 12 and affixed thereto by welding, brazing, crimping, staking or other attachment methods or means. The uppermost, exposed end of the bushing 18 may be threaded 20 for connecting to the threaded sheath of an ignition lead wire (not shown). A hexagon segment 22 is provided immediately below the threads 20 in a configuration compatible with industry standard socket wrench tools for the installation and removal of spark plugs. Although a hexagonal configuration is most common and presented here in this embodiment, it will be appreciated that other shapes and tool receiving designs may be used with equal effectiveness, depending upon the intended application for the spark plug assembly 10, such as configurations compatible with various types of spanner or box wrench tools. A small flange 24 forms an underlying ledge and shoulder for abutment with the conduit 12, while a nipple portion 26 of the bushing 18 sits snugly inside the open top end 14 of the conduit 12. Again, the fit and fastening of the bushing 18 in position to the top end 14 of the conduit 12 provides a secure, integral construction. Thus, during installation and removal, when torque is applied through the hex segment 22, the entire conduit 12 is forced to rotate together with the bushing 18. In an exemplary embodiment, bushing 18 has a length of about 1.25-2.0 inches.

A spark plug component 28 is used in this assembly (10) and may be of any suitable construction and configuration. Spark plug component 28 may include a tubular ceramic insulator 30 which preferably includes aluminum oxide or another suitable ceramic insulator material having a specified dielectric strength, high mechanical strength, high thermal conductivity, and excellent resistance to heat shock. An electrically conductive, preferably metallic shell 32 surrounds the lower regions of the insulator 30 and includes at least one ground electrode 34. Although depicted here in the traditional single L-shaped style, it will be appreciated that the ground electrode 34 may alternatively comprise multiple elements of straight or bent configuration depending upon the intended application for the spark plug assembly 10. The insulator 30 is retained within the shell 32, preferably through a hot-lock crimping operation which establishes a structurally sound assembly for retaining insulator 30 that is gas-tight so as not to leak combustion gases during use. A threaded section 36 is formed at the lower portion of the shell 32, immediately below a seat 38. The seat 38 may be paired with a gasket 41 as shown to provide a suitable interface with the cylinder head. Alternatively, the seat 38 may be designed with a taper (not shown) to provide non-gasketed installation in a cylinder head.

An electrically conductive terminal stud 40 is partially disposed in the central passage of the insulator 30 and may extend longitudinally from a threaded top post to a bottom end embedded within the central passage of the insulator 30. The threaded top post receives a threaded cap 42 which will be described in greater detail subsequently. The bottom end of the terminal stud 40 is embedded within a conductive glass seal 43 which may be of the type forming a composite suppressor/seal pack. Such glass seal packs may have numerous configurations, and are typically composed of several distinct layers, such as upper and lower conductive layers which engage terminal stud 40 and central electrode, respectively, and work in harmony to reduce electromagnetic interference during operation.

A conductive center electrode 44 extends longitudinally from a head encased in the glass seal pack to an exposed sparking end 46 proximate the ground electrode 34. A precious metal firing tip, such as may be made from an iridium-based or platinum-based alloy, may be located at the sparking end 46 of the center electrode 44 as perhaps best shown in FIG. 6. Similarly, the ground electrode 34 may be provided with a precious metal firing tip in much the same manner, thereby providing good spark erosion and corrosion performance in a combustion environment.

The bottom end 16 of conduit 12 is fitted about a complementary section on the metallic shell 32 of a conventional or only slightly modified industrial long-life spark plug component. Bottom end 16 of conduit 12 may be attached to any suitable portion of the outer surface of metallic shell 32. For example, bottom end 16 may terminate in contact with a hex portion 33. However, another approach as illustrated in the Figures includes forming a cylindrical barrel portion 35 of the shell 32 below the hex portion 33. The barrel portion 35 includes a seating shoulder 39. Forming a cylindrical portion 35 under the hex portion 33 has the advantage of creating a cylindrical interface to engage bottom end 16 of conduit 12 as well as a means to locate bottom end 16 by virtue of abutting contact with seating shoulder 39. Bottom end 16 may be affixed to shell 32 by welding, brazing, crimping or other attachment methods or means. Further, alternately, bottom end 16 may be adapted to have a hex-shaped cross-section rather than a cylindrical cross-section such that it may be engaged over the outer surface of hex portion 33 in this arrangement. Or, bottom end 16 may be fixed to some other region of the shell 32 by the methods and means described above. This arrangement has the advantage that it does not necessitate alteration of the hex portion 33 of shell 32. Depending upon the attachment method chosen, however, it may necessitate forming bottom end 16 of conduit 12 to create a hex-shaped cross-section to mate with the hex portion 33 of the spark plug 28.

Due to the elongated nature of the conduit 12, a center electrode extension 48 is provided. The center electrode extension 48 is a long, rod-like member, preferably formed from a metal, such as various grades of steel, threaded on top and bottoms ends, with its bottom end being threadably received into the cap 42 atop the stud 40. The threaded attachment to the cap 42 provides a secure, reliable electrical and mechanical connection between the center electrode extension 48 and the stud 40 of the spark plug component 28. The uppermost end of the center electrode extension 48 is also threaded to receive a plate-like contact button 50. An ignition lead (not shown), secured to the threaded end 20 of the bushing 18, extends into the top end 14 of the conduit 12 and makes electrical contact with the center electrode extension 48 via the contact button 50. Through this arrangement, timed bursts of electrical energy are transferred from an ignition system (not shown) through the spark plug component 28 to the spark gap.

In order to prevent electrical arcing between the grounded conduit 12 and highly energized center electrode extension 48, a series of stacked and nested dielectric buffers are strategically interposed. More specifically, an upper ceramic insulator 52 has a generally tubular configuration, with an upper neck portion 54 disposed inside a lower portion of the bushing 18 and a lower extending body filling the top end 14 of conduit 12. The upper ceramic insulator 52 has a central bore 56 that snugly receives the contact button 50. Thus, the upper ceramic insulator 52 establishes an electrical barrier between the highly charged contact button 50 (during timed discharges) and the grounded outer conduit 12.

An outer elastomeric insulator 58, preferably fabricated from a silicon based or silicon containing elastomer, abuts the bottom end of the upper ceramic insulator 52 and extends down to the shell 32 of the spark plug component 28. The outer elastomeric insulator 58 envelops the ceramic insulator 30 of the spark plug component 28, so that it is both electrically insulated and structurally protected, i.e., from abrasion and vibrations. In this installed assembly condition, the outer elastomeric insulator 58 may be under compression, thereby securely retaining the components in their operational positions. The outer elastomeric insulator 58 provides a dielectric barrier between the charged members of the outer portion of center electrode extension 48, cap 42 and stud 40, and that of the grounded conduit 12. The outer elastomeric insulator 58 also includes a central bore 60 which is generally coextensive with the central bore 56 established by the upper ceramic insulator 52.

An inner elastomeric insulator 62 surrounds a substantial length of the center electrode extension 48, and fills the aligned central bores 56, 60 of the upper ceramic and outer elastomeric insulators 52, 58. The inner elastomeric insulator 62, like the outer elastomeric insulator 58, is preferably made from a silicon based or silicon containing material, of which various silicone elastomers may be used.

The subject spark plug assembly 10 may be advantageously manufactured to fit engines that require a 14 mm installation bore, as an example. The assembly 10 so designed may have an outside diameter of 13/16" that is capable of fitting small diameter, deep welled bores. The subject invention is advantageous in many respects, including the ability to eliminate the need for accessory extension adaptors found in prior art assemblies, and thereby reduce the time required for maintenance and logistic effort, to reduce training efforts, and costs down time.

The subject spark plug assembly 10 enables use of a modified-to-fit conventional industrial long-life spark plug component 28 within a conduit 12 of the type comprising a sheath extension tube. The assembly 10 contains adequate internal electrical insulation to prevent internal electrical losses. Electrical energy is externally applied through the connection bushing 18 at the top portion of the assembly 10. Electrical insulation is provided by the upper ceramic insulator 52. The energy from an ignition lead wire (not shown) travels through the electrode contact button 50, through the center electrode extension 48, and finally to the long-life suppressed spark plug component 28 where the gap of the plug dissipates the externally applied electrical energy successfully within the engine environment, thereby igniting each fuel charge as required.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A spark plug assembly for deep well applications, said assembly comprising:

an elongated tubular conduit having a top end and a bottom end;

an upper ceramic insulator disposed in said conduit adjacent said top end thereof; said upper ceramic insulator having a central bore;

a lower ceramic insulator spaced apart from said upper ceramic insulator, said lower ceramic insulator disposed at least partially in said conduit adjacent said bottom end thereof;

an outer elastomeric insulator disposed in said conduit between and separating said upper and lower ceramic insulators, said outer elastomeric insulator including a central bore generally aligned with said central bore of said upper ceramic insulator to form a continuous passageway;

an elongated electrically conductive central electrode extension disposed in said continuous passageway formed by the aligned said central bores; and an inner elastomeric insulator surrounding at least a portion of said center electrode extension and simultaneously bridging said aligned central bores in said respective upper ceramic and outer elastomeric insulators.

2. The assembly of claim 1, wherein said outer elastomeric insulator and said inner elastomeric insulator are fabricated from silicone based or silicone containing elastomers.

3. The assembly of claim 1, further including a metallic shell interposed between said lower ceramic insulator and said conduit, said bottom end of said conduit being fixed to said shell.

4. The assembly of claim 3, wherein said bottom end of said conduit is welded to said shell.

5. The assembly of claim 3, wherein said center electrode extension includes a contact button slidably disposed in said central bore of said upper ceramic insulator.

6. The assembly of claim 3, further including a cap threadably engaged with one end of said center electrode extension.

7. The assembly of claim 6, wherein said cap is electrically connected to a center electrode that terminates in a sparking end.

8. The assembly of claim 7, wherein said shell includes a ground electrode spaced from said sparking end of said center electrode to form a spark gap in the space therebetween.

9. The assembly of claim 3, further including a bushing fixedly connected to said upper end of said conduit and directly contacting said upper ceramic insulator.

10. The assembly of claim 9, wherein said bushing includes thread forms for connecting to an ignition lead wire.

11. A spark plug assembly for deep well applications, said assembly comprising:

an elongated tubular conduit having a top end and a bottom end;

an upper ceramic insulator disposed in said conduit adjacent said top end thereof; said upper ceramic insulator having a central bore;

a lower ceramic insulator spaced apart from said upper ceramic insulator, said lower ceramic insulator disposed at least partially in said conduit adjacent said bottom end thereof;

an outer elastomeric insulator disposed in said conduit between and separating said upper and lower ceramic insulators, said outer elastomeric insulator including a central bore generally aligned with said central bore of said upper ceramic insulator to form a continuous passageway;

an elongated electrically conductive central electrode extension disposed in said continuous passageway formed by the aligned said central bores;

an inner elastomeric insulator surrounding at least a portion of said center electrode extension and simultaneously bridging said aligned central bores in said respective upper ceramic and outer elastomeric insulators; and a metallic shell interposed between said lower ceramic insulator and said conduit, said shell including a cylindrical barrel portion, said bottom end of said conduit being bonded to said barrel portion of said shell.

12. The assembly of claim 11, wherein said bottom end of said conduit is welded to said barrel portion of said shell.

13. The assembly of claim 11, wherein said shell includes a hex portion.

14. The assembly of claim 13, wherein said conduit is deformed in the region of said hex portion of said shell to matingly surround said hex portion.

15. The assembly of claim 11, wherein said outer elastomeric insulator is in direct contact with said shell.

16. The assembly of claim 11, wherein said center electrode extension includes a contact button slidably disposed in said central bore of said upper ceramic insulator.

17. The assembly of claim 11, further including a cap threadably engaged with one end of said center electrode extension, said cap electrically connected to a center electrode that terminates in a sparking end.

18. The assembly of claim 17, wherein said shell includes a ground electrode spaced from said sparking end of said center electrode to form a spark gap in the space therebetween.

19. The assembly of claim 11, further including a bushing fixedly connected to said upper end of said conduit and directly contacting said upper ceramic insulator.

20. The assembly of claim 19, wherein said bushing includes thread forms for connecting to an ignition lead wire.

* * * * *